US010014149B2

(12) United States Patent
Nakamura et al.

(10) Patent No.: US 10,014,149 B2
(45) Date of Patent: Jul. 3, 2018

(54) X-RAY RADIATION SOURCE AND X-RAY TUBE

(71) Applicants: Futaba Corporation, Mobara-shi, Chiba (JP); HAMAMATSU PHOTONICS K.K., Hamamatsu-shi, Shizuoka (JP)

(72) Inventors: Tatsuya Nakamura, Hamamatsu (JP); Norimasa Kosugi, Hamamatsu (JP); Naoki Okumura, Hamamatsu (JP); Yoshitaka Sato, Mobara (JP); Akira Matsumoto, Mobara (JP); Yoshihisa Marushima, Mobara (JP); Kazuhito Nakamura, Mobara (JP)

(73) Assignees: FUTABA CORPORATION, Mobara-shi, Chiba (JP); HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 119 days.

(21) Appl. No.: 14/762,477

(22) PCT Filed: Nov. 5, 2013

(86) PCT No.: PCT/JP2013/079924
§ 371 (c)(1),
(2) Date: Jul. 22, 2015

(87) PCT Pub. No.: WO2014/119080
PCT Pub. Date: Aug. 7, 2014

(65) Prior Publication Data

US 2015/0348737 A1 Dec. 3, 2015

(30) Foreign Application Priority Data

Jan. 29, 2013 (JP) ..... 2013-014174

(51) Int. Cl.
*H01J 35/18* (2006.01)
*H05G 1/06* (2006.01)
(Continued)

(52) U.S. Cl.
CPC ..... *H01J 35/18* (2013.01); *H01J 35/06* (2013.01); *H01J 35/08* (2013.01); *H05G 1/06* (2013.01);
(Continued)

(58) Field of Classification Search
CPC .. H01J 35/06; H01J 35/16; H01J 35/04; H01J 35/14; H01J 2335/16; H05G 1/06; H05G 1/10
(Continued)

(56) References Cited

U.S. PATENT DOCUMENTS 6,526,122 B2 * 2/2003 Matsushita ..... H01J 35/06 378/121
7,447,298 B2 * 11/2008 Busta ..... A23L 3/263 378/122
(Continued)

FOREIGN PATENT DOCUMENTS

CN 101449629 6/2009
CN 102347187 2/2012
(Continued)

OTHER PUBLICATIONS

English-language translation of International Preliminary Report on Patentability (IPRP) dated Aug. 13, 2015 that issued in WO Patent Application No. PCT/JP2013/079924.

*Primary Examiner* — David J Makiya
*Assistant Examiner* — Soorena Kefayati
(74) *Attorney, Agent, or Firm* — Drinker Biddle & Reath LLP

(57) ABSTRACT

In an X-ray radiation source, a counter wall made of alkali-containing glass, out of walls of a housing of an X-ray
(Continued)

tube, is sandwiched between a filament and an electric field control electrode to each of which a negative high voltage is applied. This configuration prevents an electric field from being generated in the counter wall and thus suppresses precipitation of alkali ions from the glass. Therefore, it prevents change in potential relationship between electrodes at different potentials such as the filament, grid, and target and enables stable operation to be maintained, without occurrence of a trouble of failure in maintaining a desired X-ray amount.

12 Claims, 17 Drawing Sheets

(51) Int. Cl.
*H01J 35/06* (2006.01)
*H01J 35/08* (2006.01)
*H01J 35/16* (2006.01)

(52) U.S. Cl.
CPC ..... *H01J 35/16* (2013.01); *H01J 2235/087* (2013.01)

(58) Field of Classification Search
USPC ..... 378/140, 141, 137, 139, 138, 142
See application file for complete search history.

(56) References Cited

U.S. PATENT DOCUMENTS 7,496,180 B1 * 2/2009 Subraya ..... H01J 35/14 378/137
7,526,069 B2 * 4/2009 Matsumura ..... H01J 35/18 378/119
7,801,277 B2 * 9/2010 Zou ..... H01J 35/065 378/119
7,839,978 B2 * 11/2010 Gubbels ..... B82Y 10/00 378/122
7,907,700 B2 * 3/2011 Inaba ..... H01J 35/06 378/122
8,213,575 B2 * 7/2012 Tamura ..... H01J 35/04 378/136
8,229,074 B2 * 7/2012 Mahapatra ..... H01J 35/065 378/122
8,280,006 B2 * 10/2012 Takeuchi ..... H01J 35/16 378/121
8,447,013 B2 * 5/2013 Sprenger ..... H01J 35/04 378/122
8,675,817 B2 * 3/2014 Ogata ..... H01J 35/045 378/101
9,324,535 B2 * 4/2016 Eaton ..... A61L 2/082
2002/0085674 A1 * 7/2002 Price ..... A61B 6/032 378/122
2004/0136499 A1 7/2004 Holland et al.
2006/0274889 A1 * 12/2006 Lu ..... A61B 6/4488 378/122
2008/0187093 A1 * 8/2008 Price ..... H01J 1/32 378/19
2010/0002842 A1 * 1/2010 Kerpershoek ..... H01J 35/06 378/125
2012/0027179 A1 2/2012 Ogata et al.
2013/0272503 A1 * 10/2013 Eaton ..... A61L 2/082 378/134

FOREIGN PATENT DOCUMENTS

JP H03-257745 A 11/1991
JP H09-45492 A 2/1997
JP 2002-352755 A 12/2002
JP 2007-305565 A 11/2007
JP 2012-049123 A 3/2012
TW 200746927 12/2007
WO WO 2004/023852 3/2004

* cited by examiner (a)

(b)

(a)

(b)

X-RAY RADIATION SOURCE AND X-RAY TUBE

TECHNICAL FIELD

The present invention relates to an X-ray radiation source and an X-ray tube.

BACKGROUND ART

There are the conventionally-developed X-ray radiation sources configured in the configuration wherein an X-ray tube, a high-voltage generation module, and others are incorporated in a housing having an X-ray radiation window. For example, in the industrial X-ray generation device described in Patent Literature 1, the high voltage side of a boost circuit and the cathode of the X-ray tube are arranged close to each other. For example, in the soft X-ray generation device described in Patent Literature 2, a thin film comprised of diamond grains with predetermined grain sizes is provided on the surface of an emitter. This device has the configuration wherein the whole housing of the X-ray tube is made of aluminum and wherein a metal member is located outside the surface where the cathode of the X-ray tube is arranged.

In the X-ray radiation sources as described above, it is conceivable to use alkali-containing glass, e.g., such as soda lime glass for a bottom plate of the housing or the like, from the viewpoint of matching the coefficient of thermal expansion thereof with that of power-supply terminals of the X-ray tube. Since the coefficient of thermal expansion of such glass is close to those of various electrodes and sealing materials arranged in the X-ray tube, it becomes feasible to form a vacuum housing with high vacuum maintaining performance.

CITATION LIST

Patent Literatures

Patent Literature 1: Japanese Patent Application Laid-open Publication No. 2012-49123

Patent Literature 2: Japanese Patent Application Laid-open Publication No. 2007-305565

SUMMARY OF INVENTION

Technical Problem

Incidentally, in the case where the alkali-containing glass is used for the housing of the X-ray tube, if the glass is sandwiched between a high-voltage part such as the cathode to which a negative high voltage is applied and a low-voltage part such as various control circuits to which a low voltage (or the ground potential) is applied, alkali ions can be attracted to the potential of the high-voltage part to precipitate from the glass. We found that when such precipitation of alkali ions occurred and the alkali ions adhered to the electrode or the like in the X-ray tube, the potential relationship between the electrodes could change and there was a risk of causing a trouble of failure in maintaining a desired X-ray amount.

The present invention has been accomplished in order to solve the above problem and it is an object of the present invention to provide an X-ray radiation source and an X-ray tube capable of achieving stable operation by suppressing the precipitation of alkali ions from the housing.

Solution to Problem

In order to solve the above problem, an X-ray radiation source according to the present invention comprises: an X-ray tube having a cathode to which a negative high voltage is applied, a target generating X-rays with incidence of electrons from the cathode, and a housing that houses the cathode and the target and having an output window to output the X-rays generated from the target, to the outside; and a power supply unit generating the negative high voltage to be applied to the cathode, wherein the housing has a window wall provided with the output window, and a main body portion joined to the window wall to form a housing space for housing the cathode and the target, wherein the main body portion has a counter wall arranged opposite to the window wall and made of alkali-containing glass, and wherein an electric field control electrode to which a negative high voltage substantially equal to the negative high voltage supplied to the cathode is applied from the power supply unit is arranged on an outer surface side of the counter wall.

In this X-ray radiation source, the counter wall made of the alkali-containing glass, out of the walls of the housing of the X-ray tube, is sandwiched between the cathode and the electric field control electrode to each of which the negative high voltage is applied. This configuration prevents an electric field from being generated in the counter wall and thus suppresses the precipitation of alkali ions from the glass. Therefore, it prevents the change in potential relationship between electrodes due to the adhesion of alkali ions and thus enables stable operation to be maintained, without occurrence of the trouble of failure in maintaining the desired X-ray amount.

Preferably, the cathode extends along an inner surface of the counter wall; and the electric field control electrode extends along the outer surface of the counter wall so as to face the cathode. When the cathode is arranged to extend, the precipitation of alkali ions from the counter wall becomes more likely to occur, but the precipitation of alkali ions can be suitably suppressed by arranging the electric field control electrode so as to face the cathode.

Preferably, an electron emission portion of the cathode is separated from the counter wall; between the electron emission portion and the counter wall, a back electrode to which a negative high voltage substantially equal to the negative high voltage supplied to the cathode is applied from the power supply unit is arranged so as to face the cathode; and the electric field control electrode extends along the outer surface of the counter wall so as to face the back electrode. It is considered that if the electron emission portion is arranged to directly face the counter wall, the counter wall will be charged to make the potential unstable and also make emission of electrons unstable. Therefore, this trouble can be prevented by locating the back electrode so as to face the cathode. On the other hand, the precipitation of alkali ions from the counter wall becomes more likely to occur because of an electric field formed by the back electrode closer to the counter wall, but the precipitation of alkali ions can be more suitably suppressed while realizing stable electron emission, by locating the electric field control electrode and the back electrode so as to face each other.

Preferably, the electric field control electrode is arranged so as to cover an entire area of the outer surface of the counter wall. In this case, it is feasible to more certainly prevent an electric field from being generated in the counter wall.

Preferably, the electric field control electrode is in close contact with the outer surface of the counter wall. In this case, it is feasible to more certainly prevent an electric field from being generated in the counter wall.

Preferably, the X-ray radiation source further comprises a circuit substrate on which the power supply unit is mounted; and the housing is mounted on the circuit substrate through an insulating member arranged between the electric field control electrode and the circuit substrate. In this case, the X-ray tube can be stably fixed while suppressing electric effects between the electric field control electrode and the circuit substrate.

Preferably, the X-ray radiation source further comprises a circuit substrate on which the power supply unit is mounted; the electric field control electrode is a pattern electrode formed on the circuit substrate; and the housing is mounted on the circuit substrate through the pattern electrode. In this case, the electric field control electrode can be arranged at a desired position by simply fixing the X-ray tube to the circuit substrate. In addition, it is feasible to stably perform supply of power to the electric field control electrode.

Preferably, the X-ray radiation source further comprises a circuit substrate on which the power supply unit is mounted; a through hole in which the housing can be fitted is formed in the circuit substrate; and the housing is held on the circuit substrate in a state in which the housing is fitted in the through hole, by an insulating cover provided so as to cover the counter wall and the electric field control electrode. In this case, the X-ray tube can be stably fixed while suppressing electric effects between the electric field control electrode and the circuit substrate. The X-ray radiation source can be downsized by the degree of fitting the housing in the through hole.

An X-ray tube according to the present invention has: a cathode to which a negative high voltage is applied; a target generating X-rays with incidence of electrons from the cathode; and a housing that houses the cathode and the target and having an output window to output the X-rays generated from the target, to the outside, wherein the housing has a window wall provided with the output window, and a main body portion joined to the window wall to form a housing space for housing the cathode and the target, wherein the main body portion has a counter wall arranged opposite to the window wall and made of alkali-containing glass, and wherein an electric field control electrode to which a negative high voltage substantially equal to the voltage supplied to the cathode is applied is provided on an outer surface of the counter wall.

In this X-ray tube, the counter wall made of the alkali-containing glass, out of the walls of the housing, is sandwiched between the cathode and the electric field control electrode to each of which the negative high voltage is applied. This configuration prevents an electric field from being generated in the counter wall and thus suppresses the precipitation of alkali ions from the glass. Therefore, it prevents the change in potential relationship between electrodes due to the adhesion of alkali ions and enables stable operation to be maintained, without occurrence of the trouble of failure in maintaining the desired X-ray amount.

Preferably, the cathode extends along an inner surface of the counter wall; and the electric field control electrode extends along the outer surface of the counter wall so as to face the cathode. When the cathode is arranged to extend, the precipitation of alkali ions from the counter wall becomes more likely to occur, but the precipitation of alkali ions can be suitably suppressed because the electric field control electrode and the cathode are arranged to face each other.

Preferably, an electron emission portion of the cathode is separated from the counter wall; between the electron emission portion and the counter wall, a back electrode to which a negative high voltage substantially equal to the negative high voltage supplied to the cathode is applied is arranged so as to face the cathode; and the electric field control electrode extends along the outer surface of the counter wall so as to face the back electrode. It is considered that if the electron emission portion is arranged to directly face the counter wall, the counter wall will be charged to make the potential unstable and also make the emission of electrons unstable. Therefore, this trouble can be prevented by locating the back electrode so as to face the cathode. On the other hand, the precipitation of alkali ions from the counter wall becomes more likely to occur because of an electric field formed by the back electrode closer to the counter wall, but the precipitation of alkali ions can be more suitably suppressed while realizing stable electron emission, by locating the electric field control electrode and the back electrode so as to face each other.

Preferably, the electric field control electrode is arranged so as to cover an entire area of the outer surface of the counter wall. In this case, it is feasible to more certainly prevent an electric field from being generated in the counter wall.

Preferably, the electric field control electrode is in close contact with the outer surface of the counter wall. In this case, it is feasible to more certainly prevent an electric field from being generated in the counter wall.

Preferably, an insulating member is further provided so as to cover the electric field control electrode. In this case, electric insulation can be well secured in mounting of the X-ray tube.

Furthermore, preferably, the insulating member is a sheet-like member comprised of an insulating material; and the electric field control electrode is arranged on the sheet-like member. In this case, while maintaining good electric insulation of the electric field control electrode, the electric field control electrode can be kept in closer contact with the outer surface of the counter wall.

Advantageous Effect of Invention

The present invention has achieved the realization of stable operation by suppressing the precipitation of alkali ions from the housing.

DESCRIPTION OF EMBODIMENTS

Figure 1:
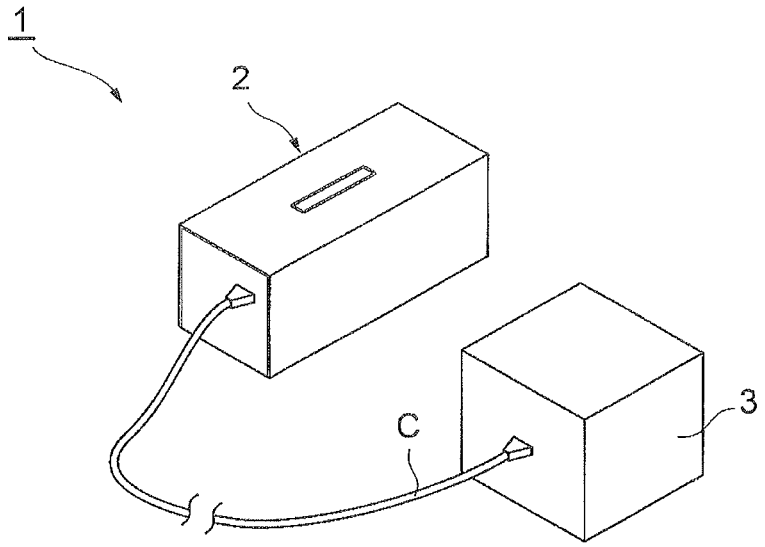
FIG. 1 is a perspective view showing an X-ray radiation device configured including the X-ray radiation source according to the first embodiment of the present invention.

FIG. 1 is a perspective view showing an X-ray radiation device configured including the X-ray radiation source according to the first embodiment of the present invention. The X-ray radiation device 1 shown in the same drawing is installed, for example, in a clean room or the like on a manufacturing line to handle large-scale glass, and is configured as a photoionizer (light irradiation type neutralization device) to remove static charges from large-scale glass by irradiation with X-rays. This X-ray radiation device 1 is configured with the X-ray radiation source 2 to radiate X-rays and a controller 3 to control the X-ray radiation source 2.

Figure 2:
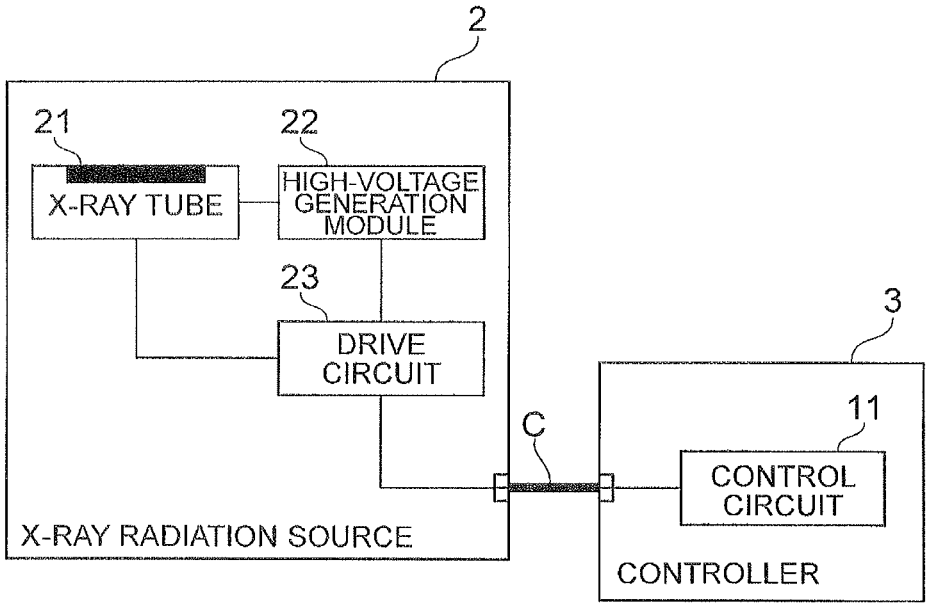
FIG. 2 is a block diagram showing functional constitutive elements of the X-ray radiation device shown in FIG. 1.

FIG. 2 is a block diagram showing functional constitutive elements of the X-ray radiation device 1. As shown in the same drawing, the controller 3 is configured including a control circuit 11. The control circuit 11 is configured, for example, including a power supply circuit to supply power to an X-ray tube 21 incorporated in the X-ray radiation source 2, a control signal transmitting circuit to transmit a control signal for controlling activation and deactivation to the X-ray tube 21, and so on. This control circuit 11 is connected to the X-ray radiation source 2 by a connection cable C.

Next, the configuration of the aforementioned X-ray radiation source 2 will be described in detail.

Figure 3:
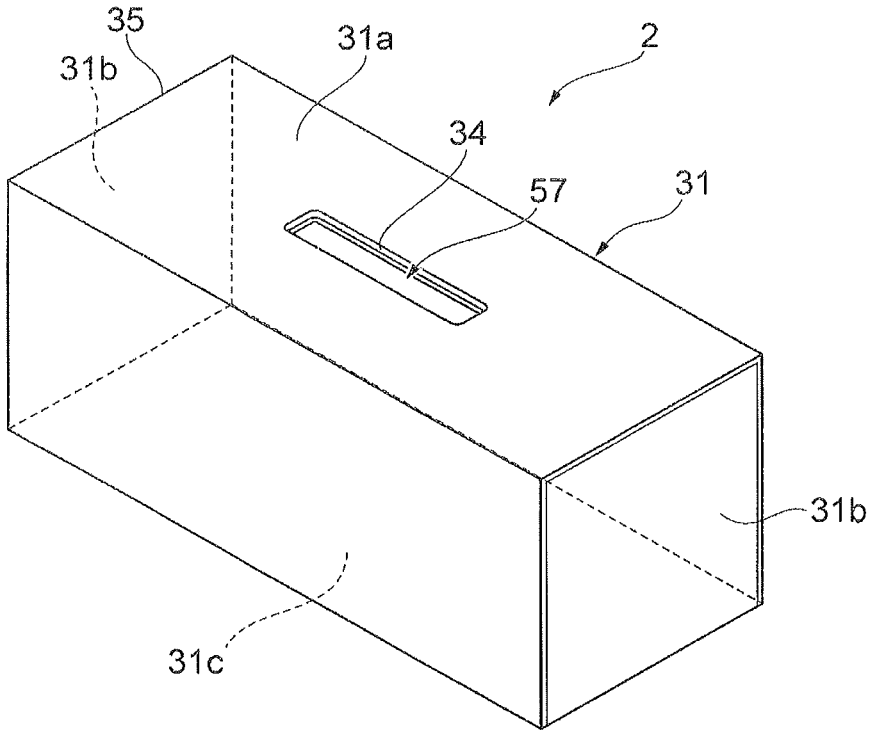
FIG. 3 is a perspective view of the X-ray radiation source shown in FIG. 1.
Figure 4:
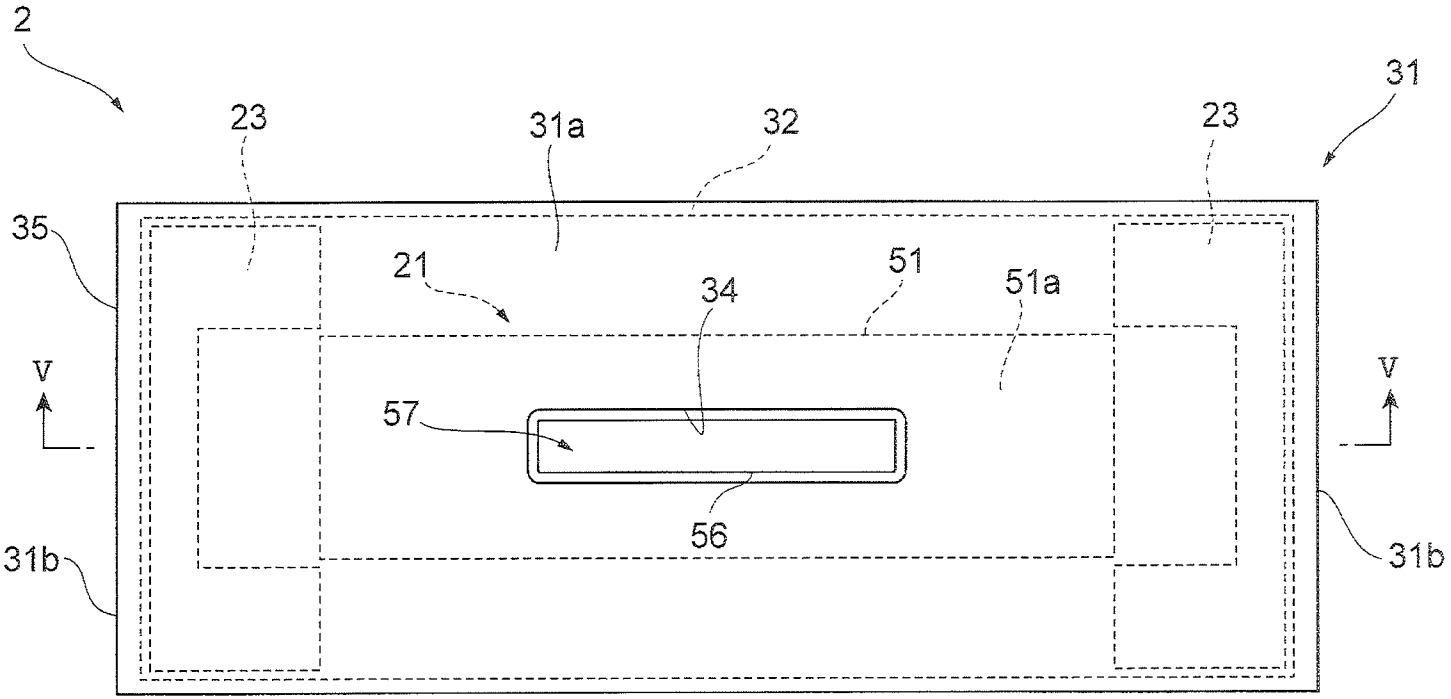
FIG. 4 is a plan view of FIG. 3.
Figure 5:
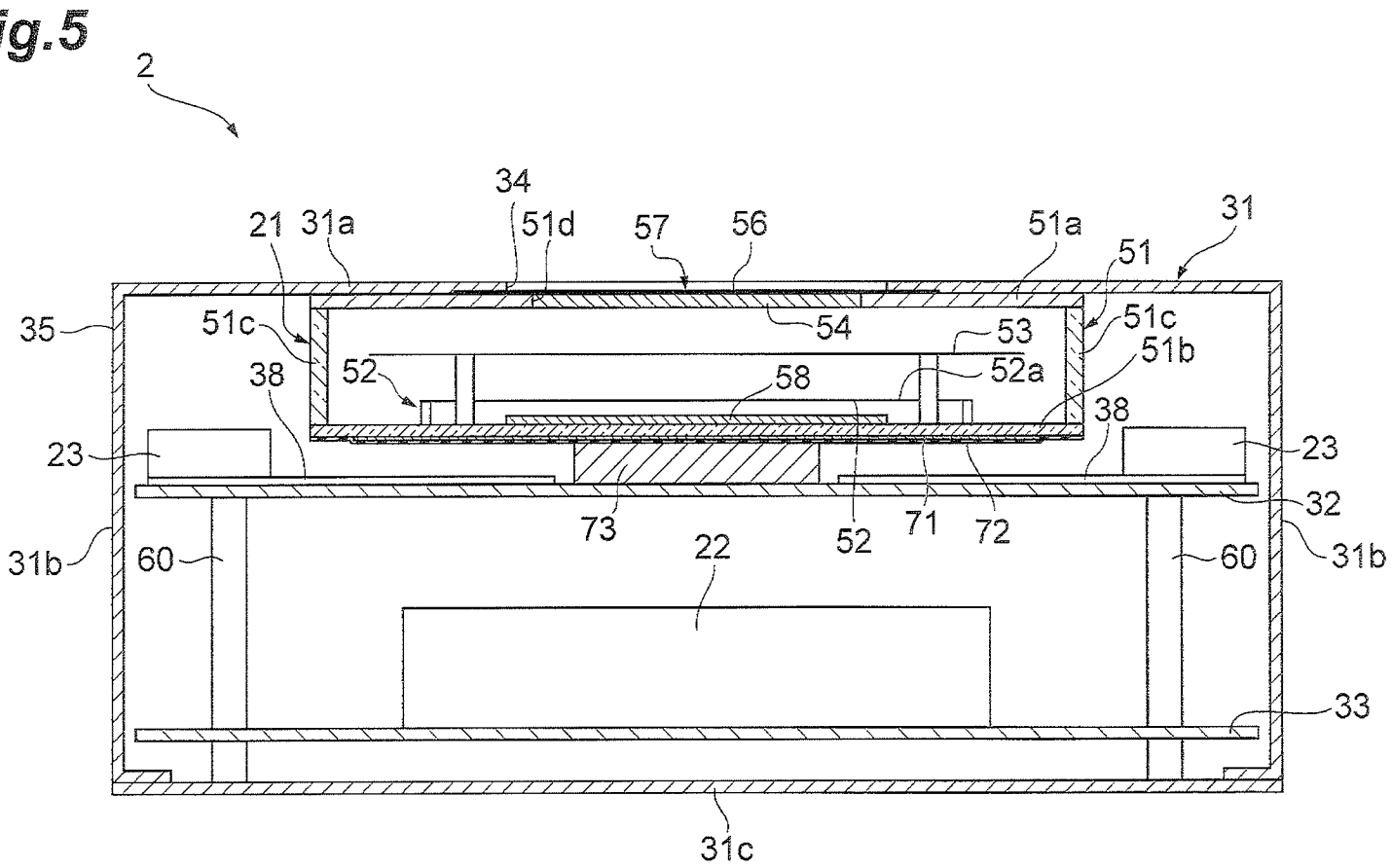
FIG. 5 is a cross-sectional view along the line V-V in FIG. 4.

FIG. 3 is a perspective view of the X-ray radiation source shown in FIG. 1. FIG. 4 is a plan view of FIG. 3 and FIG. 5 a cross-sectional view along the line V-V in FIG. 4. As shown in FIGS. 3 to 5, the X-ray radiation source 2 has the X-ray tube 21 and a high-voltage generation module 22, a first circuit substrate 32 on which at least portions of the X-ray tube 21 and drive circuit 23 are mounted, and a second circuit substrate 33 on which the high-voltage generation module 22 is mounted, in a housing 31 of a substantially rectangular parallelepiped shape made of metal.

The housing 31, as shown in FIGS. 3 and 4, is provided with a main body portion 35 which has a wall 31*a* of a rectangular shape with an X-ray output window 34 formed therein to output X-rays generated from the X-ray tube 21 to the outside, and side walls 31*b* provided on the respective sides of this wall 31*a*, while opening on one face side, and is also provided with a lid 31*c* opposed to the wall 31*a* and attached so as to close the opening of the main body portion 35. The output window 34 is comprised of an aperture formed in a rectangular shape along the longitudinal direction of the housing 31, in a substantially central region of the wall 31*a*.

The X-ray tube 21, as shown in FIG. 5, has a filament (cathode) 52 to generate an electron beam, a grid 53 to accelerate the electron beam, and a target 54 to generate X-rays in conjunction with incidence of the electron beam, in a housing 51 of a substantially rectangular parallelepiped shape sufficiently smaller than the housing 31. The housing 51 is provided with a window wall 51*a* which has an output window 57, and a main body portion which is joined to the window wall 51*a* to form a housing space for housing the filament 52, grid 53, and target 54. This main body portion is composed of a counter wall 51*b* opposed to the window wall 51*a*, and side walls 51*c* along the outer edges of the window wall 51*a* and the counter wall 51*b*. The window wall 51*a* is made, for example, of a metal plate of stainless steel or the like. The counter wall 51*b* is made, for example, of an insulating material such as glass containing alkali (sodium herein), e.g., soda lime glass or borosilicate glass. The side walls 51*c* are made, for example, of an insulating material such as glass.

The height of the side walls 51*c* is smaller than the longitudinal length of the window wall 51*a* and the counter wall 51*b*. Namely, the housing 51 is of a tabular, substantially rectangular parallelepiped shape such that the window wall 51*a* and the counter wall 51*b* can be regarded as a tabular surface. In a substantially central region of the window wall 51*a*, an aperture 51*d* slightly smaller than the X-ray output window 34 is formed in a rectangular shape along the longitudinal direction of the housing 51 (the longitudinal direction of the window wall 51*a* and the counter wall 51*b*). This aperture 51*d* constitutes the output window 57.

The filament 52 is located on the counter wall 51*b* side and the grid 53 is located between the filament 52 and the target 54. A plurality of power supply pins 55 (cf. FIG. 7) are connected to each of the filament 52 and the grid 53. The power supply pins 55 each pass between the side walls 51*c* and the counter wall 51*b* to project out to the two sides in the width direction of the housing 51 and are electrically connected to a wiring section 38 on the first circuit substrate 32. This wiring section 38 is electrically connected to the high-voltage generation module 22, constituting a part of the power supply unit in the present invention. Applied to the filament 52 through the wiring section 38 and the power supply pins 55 is a negative high voltage, e.g. about −5 kV, from the high-voltage generation module 22.

An electron emission portion 52*a* of the filament 52 is separated from the counter wall 51*b* and a back electrode 58 is arranged so as to face the filament 52, between the electron emission portion 52*a* and the counter wall 51*b*. The back electrode 58 is formed in a rectangular shape with its longitudinal direction extending along the electron emission portion 52*a* of the filament 52 and with its transverse length sufficiently larger than the diameter of the filament 52 (cf. FIG. 8) and is arranged in a state in which it is mounted in close contact with the inner surface of the counter wall 51*b*.

A plurality of power supply pins 55 different from the power supply pins 55 connected to the filament 52 are connected to the back electrode 58 and a negative high voltage, about −5 kV, is applied thereto from the high-voltage generation module 22 through the wiring section 38 and the power supply pins 55, as in the case of the filament 52.

On the other hand, a window material 56 of a rectangular shape made of a highly-radiotransparent and electroconductive material, e.g. titanium, is fixed in close contact to the outer surface side of the window wall 51*a* so as to seal the aperture 51*d*, as shown in FIG. 5, thereby constituting the output window 57 to output X-rays generated by the target 54 to the outside of the X-ray tube 21. The target 54 made, for example, of tungsten or the like is formed on the inner surface of the window material 56.

Spacer members 60 are adopted, as shown in FIG. 5, for fixing of the X-ray tube 21, high-voltage generation module 22, first circuit substrate 32, and second circuit substrate 33 in the housing 31. The spacer members 60 are formed, for example, of a ceramic in a rod shape and are not electrically conductive. The spacer members 60 are set upright on the inner surface side of the lid 31*c* in the housing 31 and support the first circuit substrate 32 with the X-ray tube 21 mounted thereon and the second circuit substrate 33 with the high-voltage generation module 22 mounted thereon so as to be approximately parallel. The lid 31*c* provided with the foregoing structure is fixed to the main body portion 35 while the output window 57 of the X-ray tube 21 is positioned so as to be exposed from the X-ray output window 34 of the housing 31.

Figure 6:
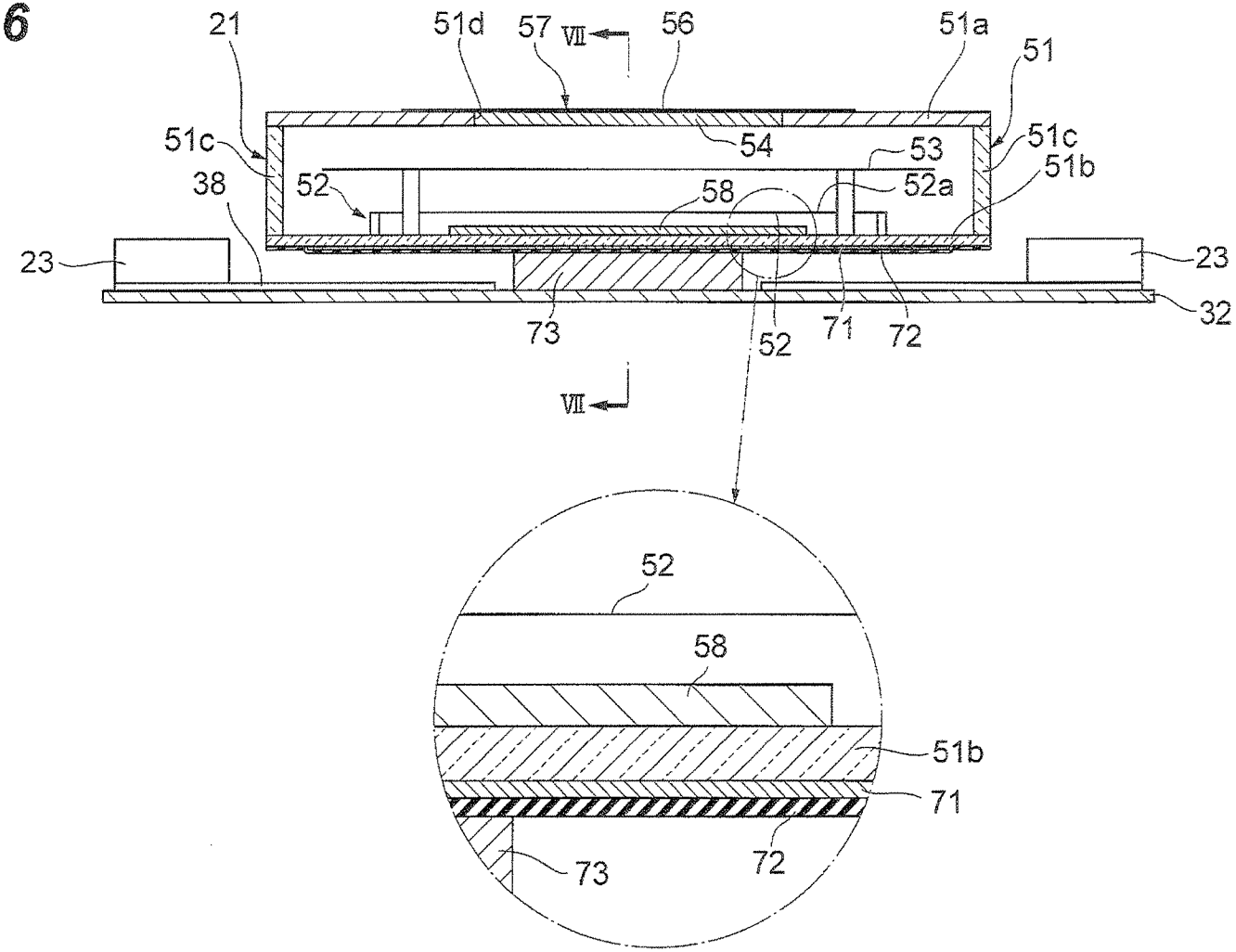
FIG. 6 is a cross-sectional view showing a coupling state between the X-ray tube and a circuit substrate.
Figure 7:
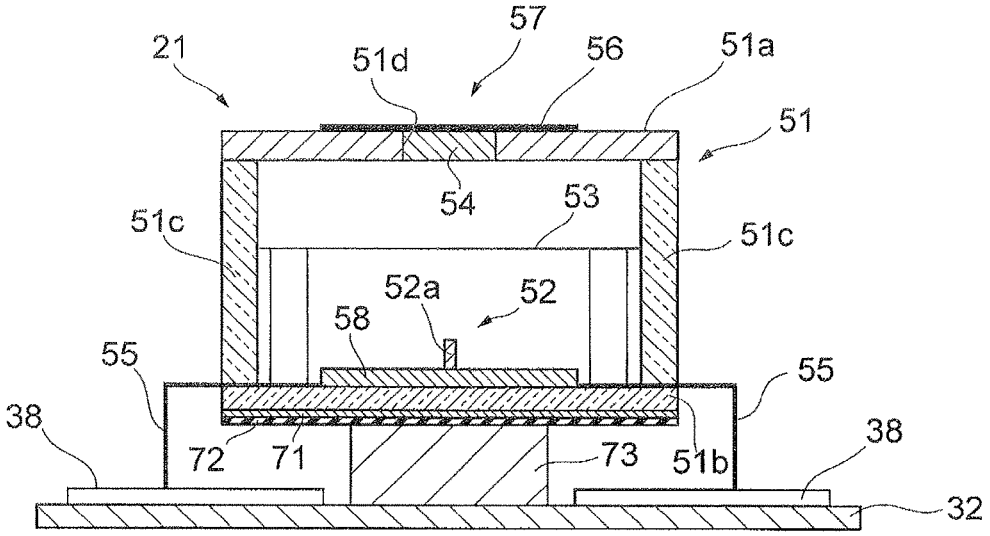
FIG. 7 is a cross-sectional view along the line VII-VII in FIG. 6.

On the other hand, the X-ray tube 21 is fixed to the first circuit substrate 32 with use of an electric filed control electrode 71, an insulating sheet (insulating member) 72, and an insulating spacer (insulating member) 73, as shown in FIGS. 6 and 7. The electric field control electrode 71 is an electroconductive planar member, e.g., a thin film such as an electroconductive tape made of copper or the like, a plate-like metal member, or the like. The electric field control electrode 71 is bonded in close contact to the outer surface side of the counter electrode 51*b* by use of an adhesive part of a tape and a negative high voltage, about −5 kV, is applied thereto from the high-voltage generation module 22, as in the case of the filament 52 and the back electrode 58. This arrangement makes the counter wall 51*b* of the alkali-containing glass sandwiched between the filament 52 and back electrode 58 to each of which the negative high voltage is applied inside the X-ray tube 21, and the electric field control electrode 71 to which the negative high voltage is applied outside the X-ray tube 21.

Figure 8:
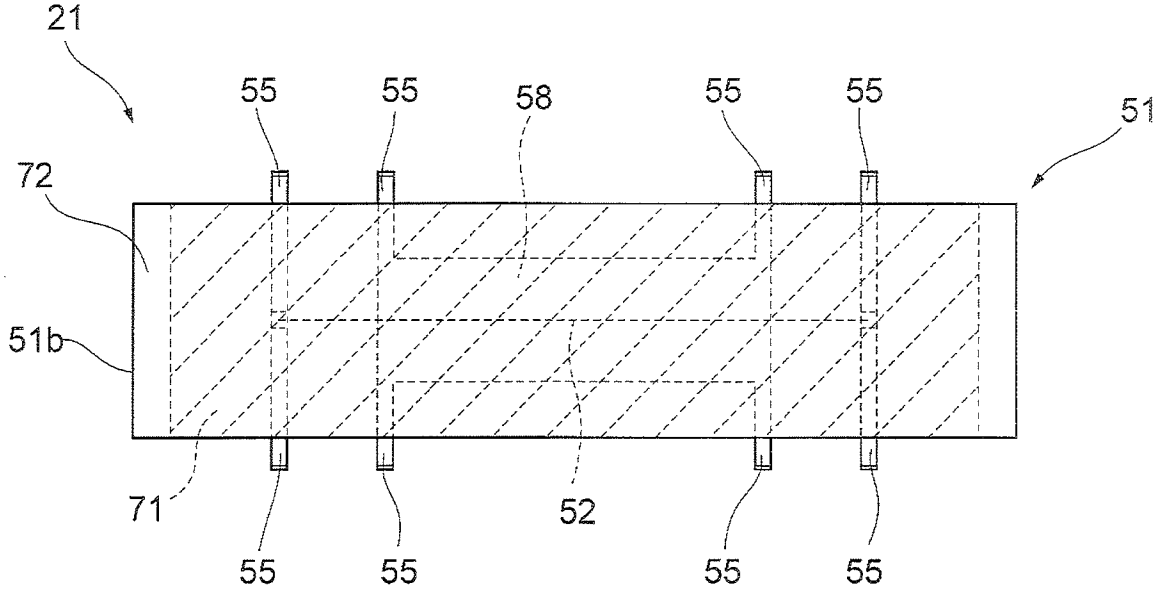
FIG. 8 is a view from the bottom side of the X-ray tube shown in FIG. 6.

The electric field control electrode 71 is preferably arranged in a region opposed to at least the whole of the back electrode 58 (including the whole). In the present embodiment the electric field control electrode 71, for example as shown in FIG. 8, extends in the same width as the counter wall 51*b* and up to positions outside the two ends of the filament 52 in the longitudinal direction of the counter wall 51*b*, so as to face the whole of the filament 52. In the example of FIG. 8, the two ends of the electric field control electrode 71 do not reach the two ends of the counter wall 51*b* but the electric field control electrode 71 may be formed across the entire surface of the counter wall 51*b*.

The insulating sheet 72 is a sheet member comprised of an insulating material, e.g., a sheet-like member made of silicone rubber. The insulating sheet 72 is, for example, of a rectangular shape approximately equal to the planar shape of the counter wall 51*b* as shown in FIG. 8, and is bonded in close contact to the outer surface side of the electric field control electrode 71 and the counter wall 51*b* so as to cover the electric filed control electrode 71 by use of adhesion with a tape or self-fusing adhesion.

The insulating spacer 73 is a block member made of an insulating material, e.g., silicone rubber. The insulating spacer 73 is, for example, of a flat, substantially rectangular parallelepiped shape slightly smaller than the back electrode 58 and is bonded to each of substantially central regions of the insulating sheet 72 and the first circuit substrate 32. This spacer 73 keeps the X-ray tube 21 separated from the first circuit substrate 32 so as to prevent the insulating sheet 72 from coming into contact with the wiring section 38.

In the X-ray radiation source 2 having the configuration as described above, the counter wall 51*b* made of the alkali-containing glass, out of the walls of the housing 51 of the X-ray tube 21, is sandwiched between the filament 52 and the electric field control electrode 71 to each of which the negative high voltage is applied. This configuration prevents an electric field from being generated in the counter wall 51*b* and thus suppresses the precipitation of alkali ions from the glass.

If alkali ions precipitate from the glass, the problems as described below will arise. For example, if the alkali ion precipitates adhere to the surface of an insulating member such as the inner wall surface of the housing 51, the withstand voltage performance might degrade. This can also lead to degradation of withstand voltage performance between electrodes at different potentials, such as the filament 52, the grid 53, and the target 54, which can make it difficult to apply the voltages necessary for drive of the X-ray tube 21 between the electrodes. If the alkali ion precipitates adhere to the grid 53, a potential relationship with the filament 52 can change because of a difference between work functions of the material making up the grid 53 and the adhering alkali ions, which can make it difficult to stably extract electrons from the filament 52.

Therefore, the electric filed control electrode 71 prevents an electric field from being generated in the counter wall 51*b* and thus suppresses the precipitation of alkali ions from the glass, thereby preventing the change in the potential relationship between electrodes at different potentials, such as the filament 52, the grid 53, and the target 54, and enabling the stable operation to be maintained, without causing the trouble of failure in maintaining the desired X-ray amount. If the alkali ion precipitates adhere to the filament 52, the surface condition of the filament 52 will change, so as to lead to a possibility of change in electron emission capability as well; however, this problem can also be avoided by suppressing the precipitation of alkali ions from the glass.

In the X-ray radiation source 2, the filament 52 extends in the longitudinal direction along the inner surface of the counter wall 51*b* and the electric field control electrode 71 is in close contact with the outer surface of the counter wall 51*b* so as to face the whole of the filament 52. The precipitation of alkali ions from the counter wall 51*b* also becomes more likely to occur in the case where the filament 52 is arranged to extend, but the precipitation of alkali ions can be suitably suppressed by locating the electric field control electrode 71 so as to face the whole of the filament 52. When the electric field control electrode 71 is in close contact with the counter wall 51*b*, the effect to prevent the electric field can be further enhanced. When the electric field control electrode 71 does not reach the two ends of the counter wall 51*b*, as shown in FIG. 8, it can limit a range where a high voltage region is formed. On the other hand, when the electric field control electrode 71 is formed across the entire area of the outer surface of the counter wall 51*b*, the sufficient area of the electric field control electrode 71 is secured, so as to more certainly prevent an electric field from being generated in the counter wall 51*b*.

In the X-ray radiation source 2, the electron emission portion 52*a* of the filament 52 is separated from the counter wall 51*b* and, the back electrode 58 to which the negative high voltage approximately equal to the negative high voltage supplied to the filament 52 is applied from the high-voltage generation module 22 is arranged so as to face the filament 52, between the electron emission portion 52*a* and the counter wall 51*b*. The electric field control electrode 71 extends along the outer surface of the counter wall 51*b* so as to face the back electrode 58. It is considered that when the electron emission portion 52*a* is arranged to directly face the counter wall 51*b*, the counter wall 51*b* can be charged to make the potential unstable and also make the emission of electrons unstable. Therefore, this problem can be prevented by locating the back electrode 58 so as to face the filament 52. On the other hand, the precipitation of alkali ions from the counter wall 51*b* becomes more likely to occur by an electric field generated by the back electrode 58 closer to the counter wall 51*b* than the filament 52. Then, the present embodiment is so arranged that the electric field control electrode 71 is opposed to the back electrode 58, whereby the precipitation of alkali ions from the counter wall 51*b* can be more certainly suppressed, while realizing stable electron emission.

In the X-ray radiation source 2, the electric field control electrode 71 is covered by the insulating sheet 72 and the housing 51 of the X-ray tube 21 is mounted through the insulating spacer 73 on the first circuit substrate 32. This configuration adequately guarantees insulation between the electric field control electrode 71 and the first circuit substrate 32 and suppresses electric effects between the electric field control electrode 71 and the first circuit substrate 32; therefore, it is feasible to stably maintain the potential of the electric field control electrode 71 and the operation of the first circuit substrate 32 and to stably fix the X-ray tube 21 to the first circuit substrate 32.

The foregoing electric field control electrode 71 may be a metal deposited film formed on the outer surface of the counter wall 51*b* or on the insulating sheet, as well as the electroconductive tape. The insulating sheet 72 may be an inorganic film of silicone resin, ceramic, polyimide, or the like. The insulating spacer 73 may be silicone resin, urethane, or the like. The coupling of each member of the counter wall 51*b*, electric field control electrode 71, insulating sheet 72, and insulating spacer 73 is preferably implemented by a technique capable of securing adhesion between surfaces, such as a seal or adhesive. It is also preferred to use a material with a self-fusing property as the insulating material.

Figure 9:
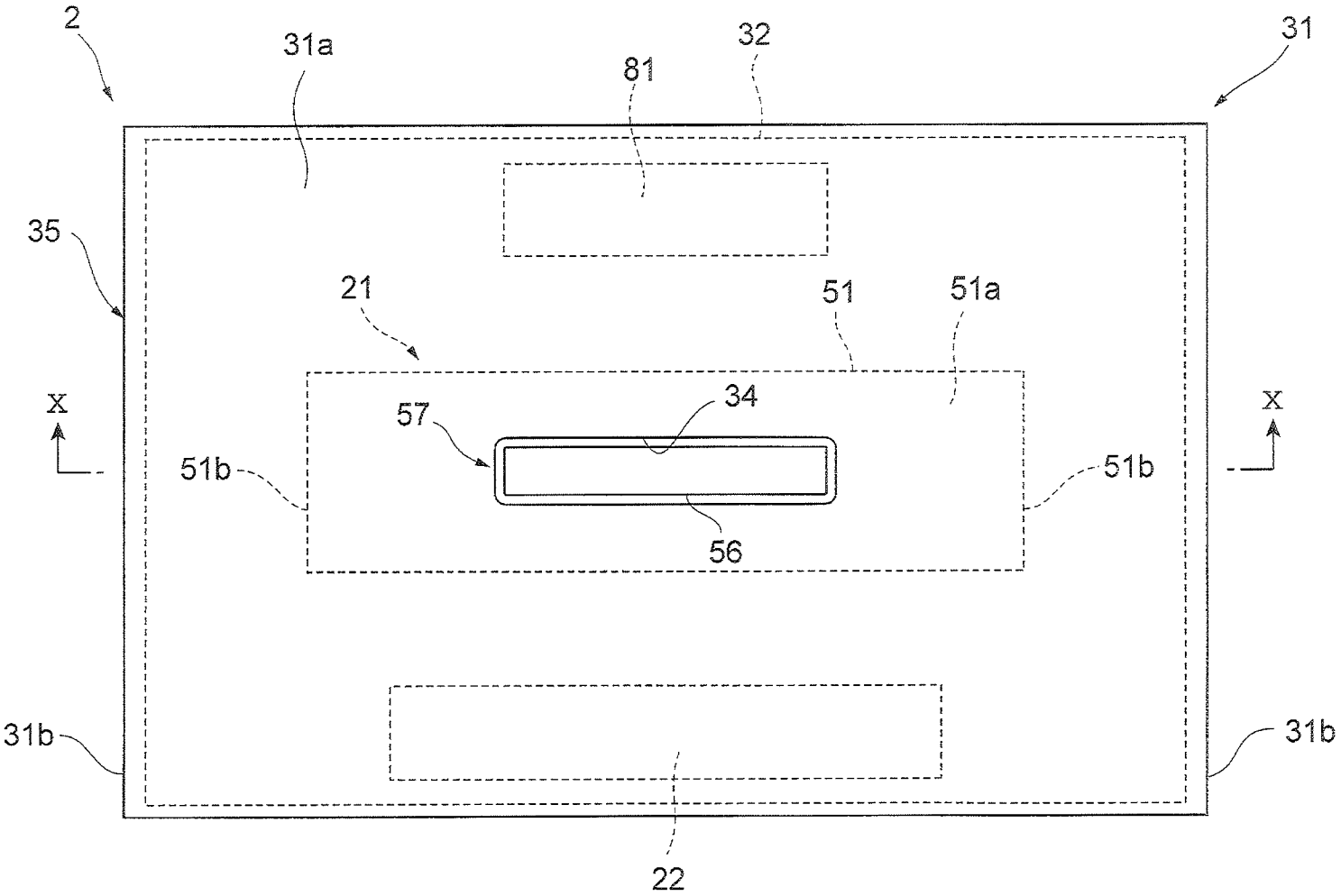
FIG. 9 is a plan view showing the X-ray radiation source according to a modification example.
Figure 10:
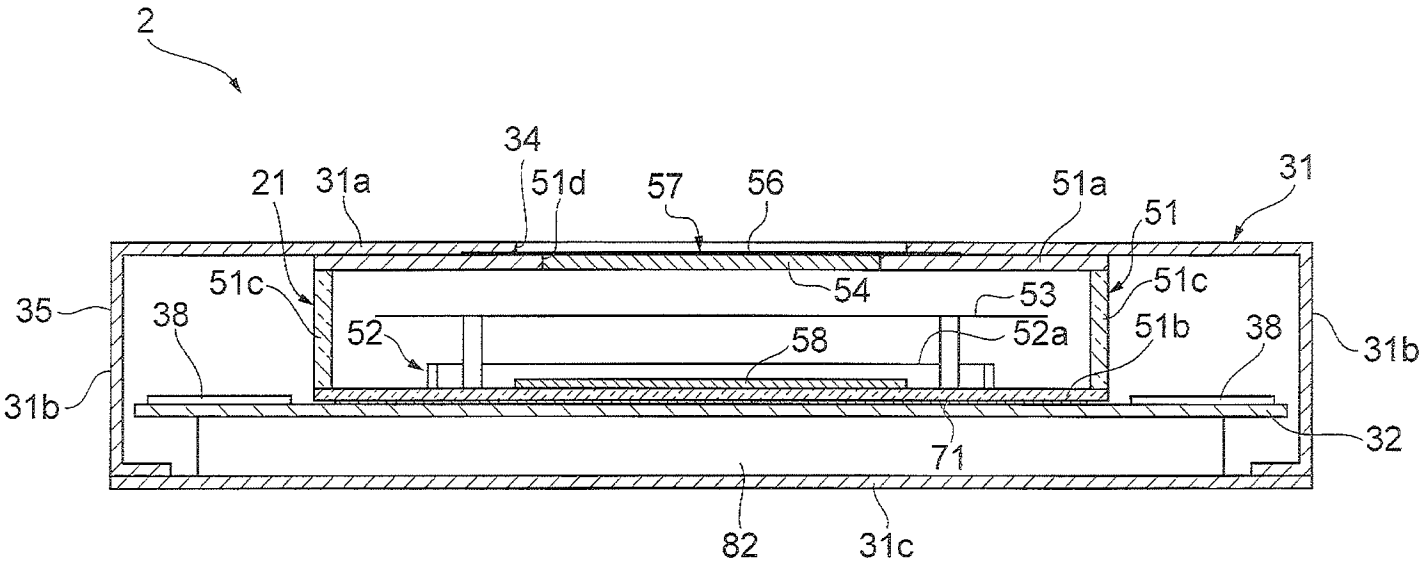
FIG. 10 is a cross-sectional view along the line X-X in FIG. 9.

It is also possible to adopt a configuration as shown in FIGS. 9 and 10, wherein the housing and first circuit substrate used are the housing 31 and first circuit substrate 32 with the area larger than the first circuit substrate 32 shown in FIGS. 4 and 5, there is an arrangement region 81 of the drive circuit 23 for drive of the X-ray tube 21 on one side in the width direction of the X-ray tube 21 on one surface side of the first circuit substrate 32, and the high-voltage generation module 22 is mounted on the other side. In this example, a spacer member 82 of a frame shape is fixed to the lid 31*c* and the first circuit substrate 32 is fixed to the top end of the spacer member 82. In this case, the number of circuit substrates is reduced, so as to make the thickness of the housing 31 smaller.

Second Embodiment

Figure 11:
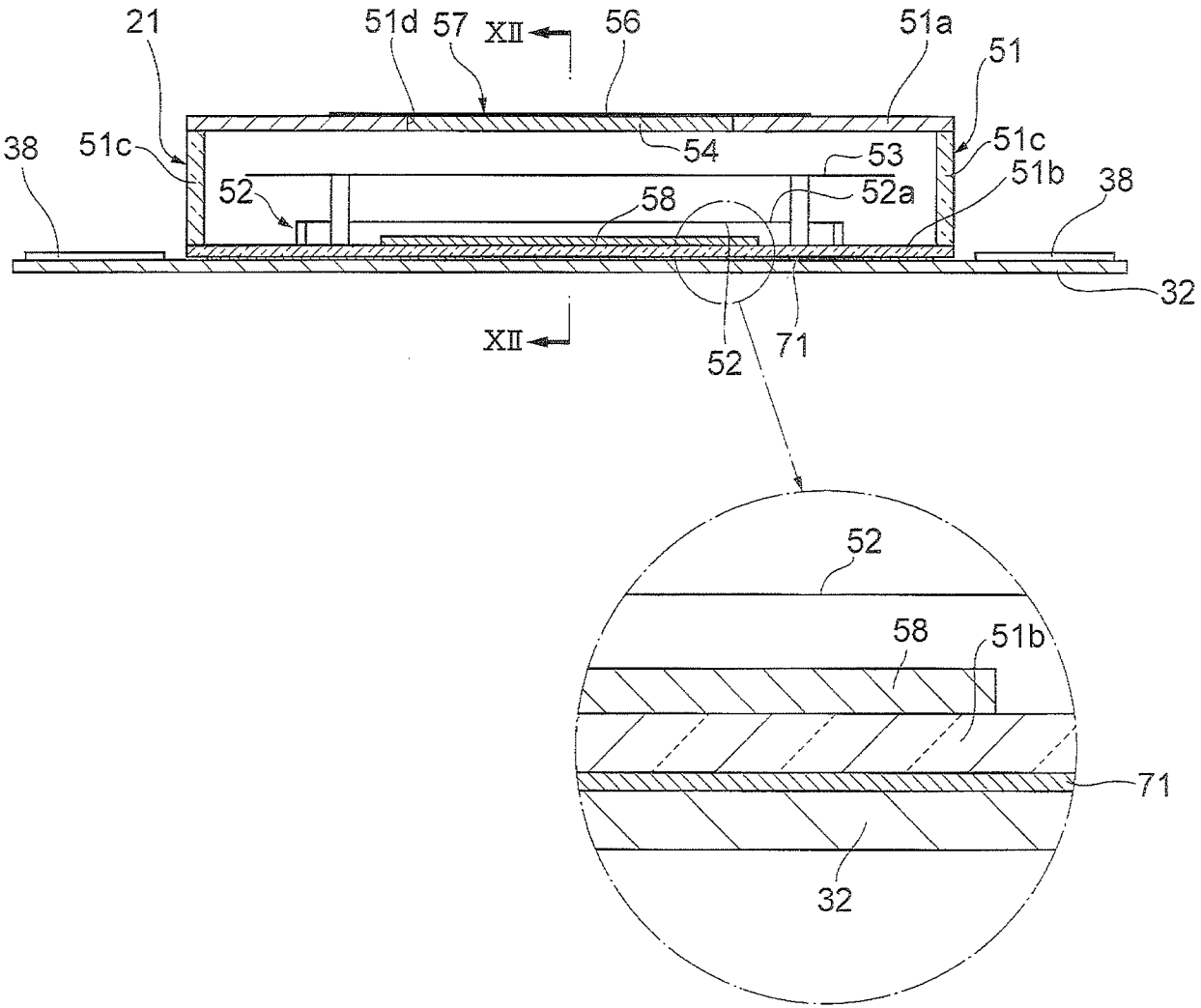
FIG. 11 is a cross-sectional view showing a coupling state between the X-ray tube and the circuit substrate in the X-ray radiation source according to the second embodiment of the present invention.
Figure 12:
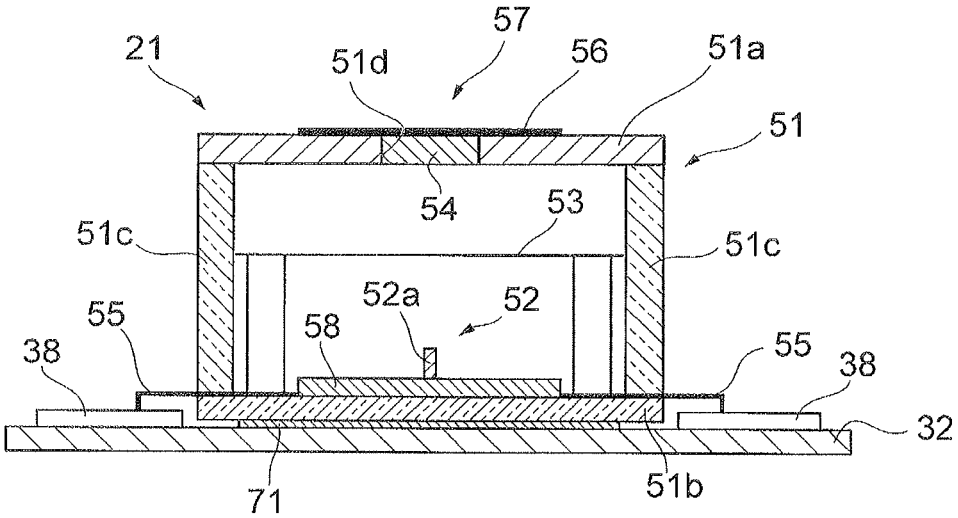
FIG. 12 is a cross-sectional view along the line XII-XII in FIG. 11.

FIGS. 11 and 12 are cross-sectional views showing a coupling state between the X-ray tube and the circuit substrate in the X-ray radiation source according to the second embodiment of the present invention. As shown in the same drawings, the X-ray radiation source according to the second embodiment is different in the coupling state between the X-ray tube 21 and the first circuit substrate 32 from the first embodiment.

Figure 13:
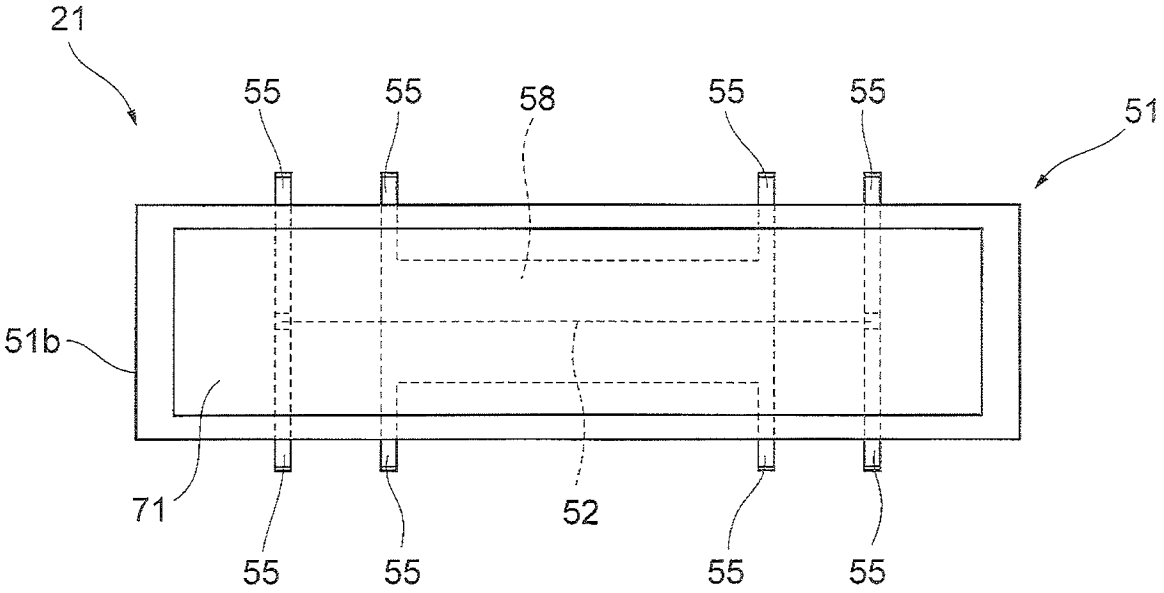
FIG. 13 is a view from the bottom side of the X-ray tube shown in FIG. 11.

More specifically, the present embodiment does not use the insulating sheet 72 and insulating spacer 73, and the electric field control electrode 71 is formed as a pattern electrode on the first circuit substrate 32. Furthermore, the housing 51 is mounted on the first circuit substrate 32 through the electric field control electrode 71. The electric field control electrode 71 is preferably arranged in a region opposed to at least the whole of the back electrode 58, just as in the first embodiment, and, for example as shown in FIG. 13, it is provided so as to face the whole of the back electrode 58 and the filament 52, in a region of a rectangular shape slightly smaller than the counter wall 51*b*.

In this configuration, the counter wall 51*b* made of the alkali-containing glass, out of the walls of the housing 51 of the X-ray tube 21, is also sandwiched between the filament 52 and the electric field control electrode 71 to each of which the negative high voltage is applied. This prevents an electric field from being generated in the counter wall 51*b* and suppresses the precipitation of alkali ions from the glass. Therefore, it suppresses the change in the potential relationship between electrodes at different potentials such as the filament 52, grid 53, and target 54 and thus prevents occurrence of the trouble of failure in maintaining the desired X-ray amount, thereby enabling stable operation to be maintained.

By simply fixing the X-ray tube 21 to the first circuit substrate 32, the electric field control electrode 71 can be stably located at the desired position and the supply of power to the electric field control electrode 71 can be stably carried out. It is also possible to adopt a configuration wherein a recess of a substantially rectangular shape corresponding to the planar shape of the counter wall 51*b* is formed in the first circuit substrate 32, the electric field control electrode 71 is formed as a pattern electrode on the bottom part of the recess, and the housing 51 is fitted in the recess. In this case, the thickness of the device can be reduced by the degree of the depth of the recess.

In the present embodiment, it is also possible to adopt the configuration as shown in FIGS. 9 and 10, wherein the housing and first circuit substrate used are the housing 31 and first circuit substrate 32 with the area larger than the first circuit substrate 32, there is the arrangement region 81 of the drive circuit 23 for drive of the X-ray tube 21 on one side in the width direction of the X-ray tube 21 on one surface side of the first circuit substrate 32, and the high-voltage generation module 22 is mounted on the other side.

Third Embodiment

Figure 14:
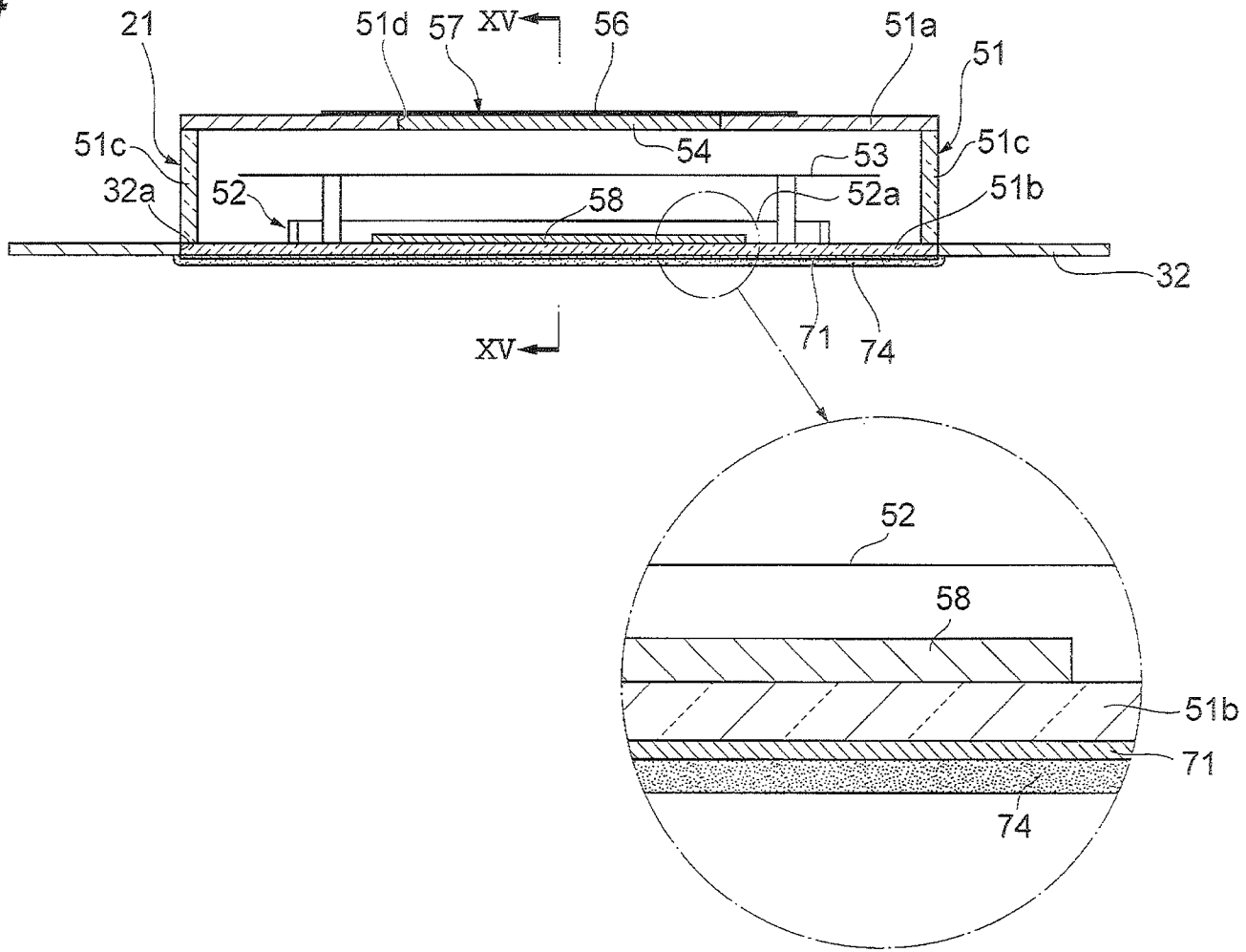
FIG. 14 is a cross-sectional view showing a coupling state between the X-ray tube and the circuit substrate in the X-ray radiation source according to the third embodiment of the present invention.
Figure 15:
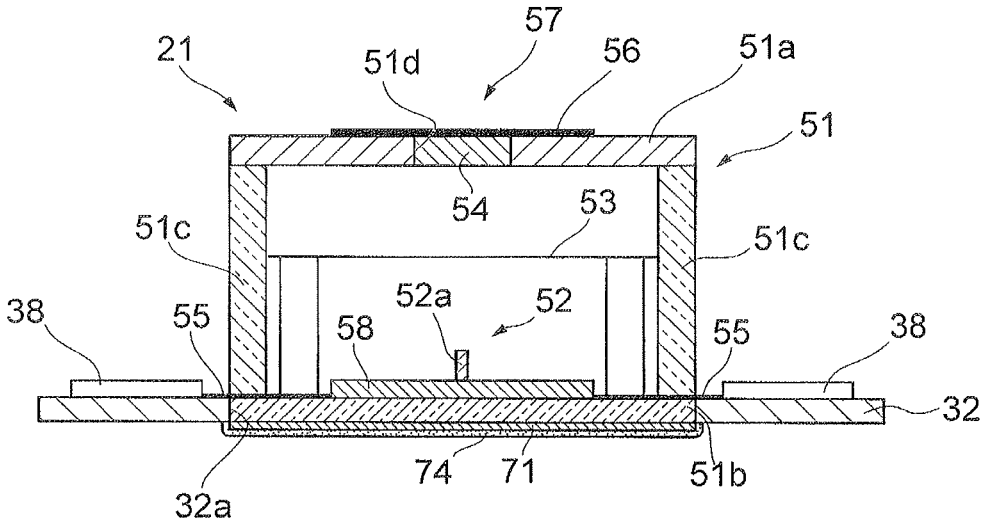
FIG. 15 is a cross-sectional view along the line XV-XV in FIG. 14.

FIGS. 14 and 15 are cross-sectional views showing a coupling state between the X-ray tube and the circuit substrate in the X-ray radiation source according to the third embodiment of the present invention. As shown in the same drawings, the X-ray radiation source according to the third embodiment is further different in the coupling state between the X-ray tube 21 and the first circuit substrate 32 from the first embodiment.

More specifically, the present embodiment does not use the insulating sheet 72 and insulating spacer 73, and only the electric field control electrode 71 is provided on the outer surface side of the counter wall 51*b*. On the other hand, a through hole 32*a* of a substantially rectangular shape corresponding to the planar shape of the counter wall 51*b* is formed in a substantially central region of the first circuit substrate 32. The depth of this through hole 32*a*, i.e., the thickness of the first circuit substrate 32 is approximately equal to the thickness of the counter wall 51*b* in the housing 51. The X-ray tube 21 is held on the first circuit substrate 32 in such a manner that the counter wall 51*b* is located in the through hole 32*a* and that each power supply pin 55 is connected to the wiring section 38 of the first circuit substrate 32.

A molded portion (insulating cover) 74 is provided on the coupling part between the X-ray tube 21 and the first circuit substrate 32. The molded portion 74 is made, for example, of an insulating resin such as silicone or epoxy and provided so as to cover the electric field control electrode 71 and cover the gap between the X-ray tube 21 and the through hole 32*a*, on the back side of the first circuit substrate 32. For this reason, while suppressing electric effects such as discharge and electrostatic induction between the electric field control electrode 71 and the first circuit substrate 32, the X-ray tube 21 can be stably fixed.

In this configuration, the counter wall 51*b* made of the alkali-containing glass, out of the walls of the housing 51 of the X-ray tube 21, is also sandwiched between the filament 52 and the electric field control electrode 71 to each of which the negative high voltage is applied. This prevents an electric field from being generated in the counter wall 51*b* and thus suppresses the precipitation of alkali ions from the glass. Therefore, it suppresses the change in the potential relationship between electrodes at different potentials such as the filament 52, grid 53, and target 54 and thus prevents occurrence of the trouble of failure in maintaining the desired X-ray amount, thereby enabling stable operation to be maintained.

In this configuration, the housing 51 is fitted in the through hole 32*a*, whereby the thickness of the device can be reduced by the degree of the depth of the through hole 32*a*. Since the molded portion 74 is provided so as to cover the through hole 32*a*, the housing 51 is supported by the molded portion 74, whereby the X-ray tube 21 can be stably mounted on the first circuit substrate 32.

[Tests to Confirm Effect of Invention]

Figure 16:
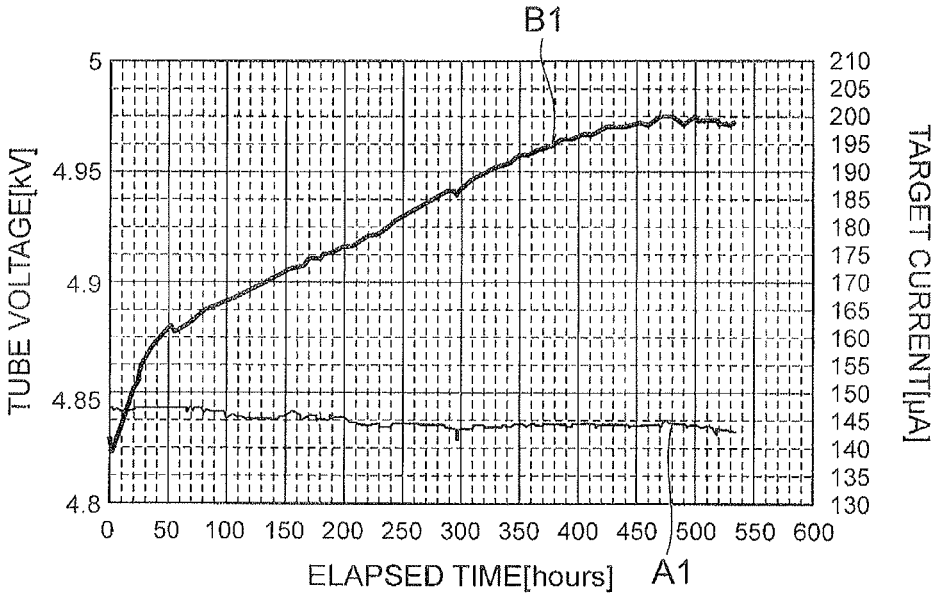
FIG. 16 is a drawing showing the result of a test to confirm the effect of the present invention, including (a) the result of Comparative Example and (b) the result of Example.
Figure 16:
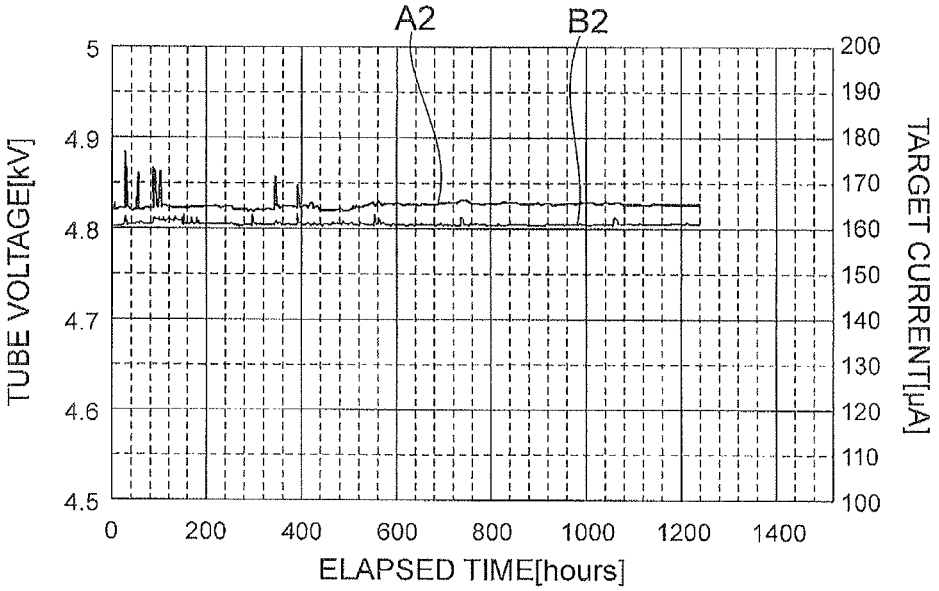

FIG. 16 is a drawing showing the result of a test to confirm the effect of the present invention. This test was carried out by monitoring the tube voltage and target current of the X-ray tube after a start of operation, for Example with the electric field control electrode on the counter wall and for Comparative Example without the electric field control electrode on the counter wall. In the case of Comparative Example, as shown in FIG. 16 (*a*), with the lapse of time from the operation start, there is no change in the tube voltage A1 observed but the target current B1 demonstrates an increase of about 50 μA from the initial value. In contrast to it, as shown in FIG. 16 (*b*), Example showed little change in both of the tube voltage A2 and the target current B2, even after the lapse of time from the operation start. It was confirmed by this result that the electric field control electrode of the present invention suppressed the precipitation of alkali ions from the glass and contributed to stabilization of operation of the X-ray radiation source.

Figure 17:
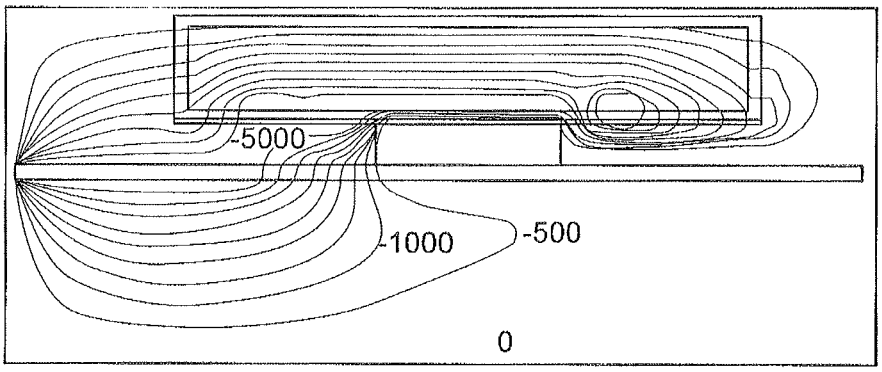
FIG. 17 is a drawing showing the result of another test to confirm the effect of the present invention, including (a) the result of Comparative Example and (b) the result of Example.
Figure 17:
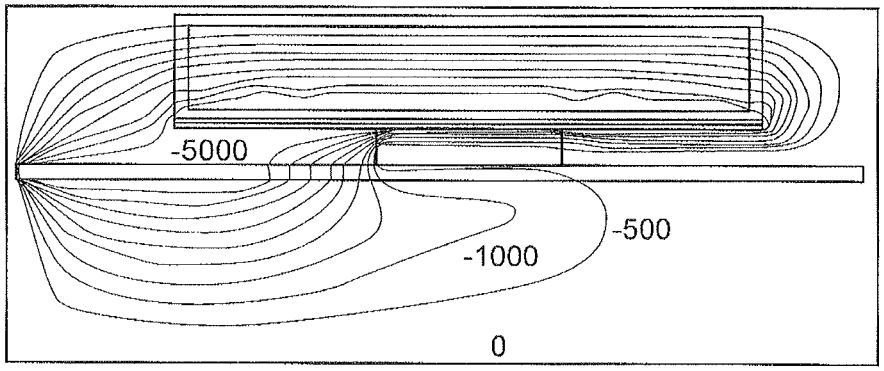

FIG. 17 is a drawing showing the result of another test to confirm the effect of the present invention. This test was carried out by simulation of a potential distribution around the housing of the X-ray tube, for Example with the electric field control electrode on the counter wall and for Comparative Example without the electric field control electrode on the counter wall. In the case of Comparative Example, as shown in FIG. 17 (*a*), a high electric field (calculated value: 2.5 E+6 V/m) was generated in the counter wall above the insulating spacer and generation of an electric field was also observed around the edges of the counter wall in close proximity to the low-voltage component. In contrast to it, as shown in FIG. 17 (*b*), it was confirmed that in the case of Example there was no electric field generated throughout the whole of the counter wall.

REFERENCE SIGNS LIST

2 X-ray radiation source; 21 X-ray tube; 22 high-voltage generation module (power supply unit); 32 first circuit substrate (circuit board); 32*a* through hole; 38 wiring section (power supply unit); 51 housing; 51*a* window wall; 51*b* counter wall; 52 filament (cathode); 52*a* electron emission portion; 54 target; 57 output window; 58 back electrode; 71 electric field control electrode; 72 insulating sheet (insulating member); 73 insulating spacer (insulating member); 74 molded portion (insulating cover).

The invention claimed is:

1. An X-ray radiation source comprising:

an X-ray tube comprising:

a cathode to which a negative high voltage is applied and extending along an inner surface of a counter wall, a target that generates X-rays with incidence of electrons from the cathode, and a housing that houses the cathode and the target, the housing comprising:

a window wall with an output window which outputs the X-rays generated from the target to the outside;

a back electrode; and a main body portion, comprising a counter wall arranged opposite to the window wall, the main body portion joined to the window wall to form a housing space for the cathode and the target, the counter wall comprising alkali-containing glass, the cathode extending along an inner surface of the counter wall;

a power supply unit that generates the negative high voltage applied to the cathode, an electric field control electrode that is a planar member that has conductivity, controls the electric field occurring at the counter wall, and to which a negative high voltage substantially equal to the negative high voltage supplied to the cathode is applied from the power supply unit, the electric field control electrode being arranged apart from the cathode on an outer surface side of the housing space on an outer surface side of the counter wall to face the cathode and being disposed in a range that includes the entire cathode and back electrode, the counter wall being disposed between the cathode and the electric field control electrode, the outer surface side of the counter wall being a side opposite to an electron emission direction from the cathode toward the target, the electric field control electrode being in close contact with the outer surface of the counter wall, and a circuit substrate on which the power supply unit is mounted, wherein the electric field control electrode is formed on the circuit substrate and the housing is mounted on the circuit substrate through the electric field control electrode.

2. The X-ray radiation source according to claim 1, wherein an electron emission portion of the cathode is separated from the counter wall, wherein between the electron emission portion and the counter wall, the back electrode to which a negative high voltage substantially equal to the negative high voltage supplied to the cathode is applied from the power supply unit is arranged so as to face the cathode, and wherein the electric field control electrode extends along the outer surface of the counter wall so as to face the back electrode.

3. The X-ray radiation source according to claim 1, wherein the electric field control electrode is arranged so as to cover an entire area of the outer surface of the counter wall.

4. The X-ray radiation source according to claim 1, wherein the housing is mounted on the circuit substrate through an insulating member arranged between the electric field control electrode and the circuit substrate.

5. The X-ray radiation source according to claim 1, wherein a through hole in which the housing can be fitted is formed in the circuit substrate, and wherein the housing is held on the circuit substrate in a state in which the housing is fitted in the through hole, by an insulating cover provided so as to cover the counter wall and the electric field control electrode.

6. The X-ray radiation source according to claim 1, wherein the main body portion of the housing internally comprises a hollow housing space.

7. An X-ray tube having:

a cathode to which a negative high voltage is applied and extending along an inner surface of a counter wall;

a target that generates X-rays with incidence of electrons from the cathode; and a housing that houses the cathode and the target, the housing comprising:

a window wall with an output window which outputs the X-rays generated from the target to the outside;

a main body portion, comprising a counter wall arranged opposite to the window wall, the main body portion joined to the window wall to form a housing space for the cathode and the target, the counter wall comprising alkali-containing glass, the cathode extending along an inner surface of the counter wall;

an electric field control electrode that is a planar member that has conductivity, controls the electric field occurring at the counter wall, and to which a negative high voltage substantially equal to the voltage supplied to the cathode is applied from a power supply unit, the electric field control electrode being arranged apart from the cathode on an outer surface side of the housing space on an outer surface side of the counter wall to face the cathode and being disposed in a range that includes the entire cathode and back electrode, the counter wall being disposed between the cathode and the electric field control electrode, the outer surface side of the counter wall being a side opposite to an electron emission direction from the cathode toward the target, the electric field control electrode being in close contact with the outer surface of the counter wall, and wherein a circuit substrate on which the power supply unit is mounted, wherein the electric field control electrode is formed on the circuit substrate and the housing is mounted on the circuit substrate through the electric field control electrode.

8. The X-ray tube according to claim 7, wherein an electron emission portion of the cathode is separated from the counter wall, wherein between the electron emission portion and the counter wall, the back electrode to which a negative high voltage substantially equal to the negative high voltage supplied to the cathode is applied is arranged so as to face the cathode, and wherein the electric field control electrode extends along the outer surface of the counter wall so as to face the back electrode.

9. The X-ray tube according to claim 7, wherein the electric field control electrode is arranged so as to cover an entire area of the outer surface of the counter wall.

10. The X-ray tube according to claim 7, wherein an insulating member is further provided so as to cover the electric field control electrode.

11. The X-ray tube according to claim 7, wherein the main body portion of the housing internally comprises a hollow housing space.

12. The X-ray tube according to claim 10, wherein the insulating member is a sheet-like member comprised of an insulating material, and wherein the electric field control electrode is arranged on the sheet-like member.

* * * * *